US011098665B2

(12) United States Patent
Panciroli

(10) Patent No.: US 11,098,665 B2
(45) Date of Patent: Aug. 24, 2021

(54) METHOD FOR ESTIMATING AND CONTROLLING THE INTAKE EFFICIENCY OF AN INTERNAL COMBUSTION ENGINE

(71) Applicant: MARELLI EUROPE S.p.A., Corbetta (IT)

(72) Inventor: Marco Panciroli, Corbetta (IT)

(73) Assignee: MARELLI EUROPE S.p.A., Corbetta (IT)

( * ) Notice: Subject to any disclaimer, the term of this patent is extended or adjusted under 35 U.S.C. 154(b) by 0 days.

(21) Appl. No.: 16/874,254

(22) Filed: May 14, 2020

(65) Prior Publication Data

US 2020/0362781 A1 Nov. 19, 2020

(30) Foreign Application Priority Data

May 15, 2019 (IT) ..... 102019000006862

(51) Int. Cl.
*F02D 41/18* (2006.01)
*F02D 41/00* (2006.01)
*F02M 26/47* (2016.01)

(52) U.S. Cl.
CPC ..... *F02D 41/0072* (2013.01); *F02D 41/0007* (2013.01); *F02M 26/47* (2016.02);
(Continued)

(58) Field of Classification Search
CPC ..... F02D 41/0072; F02D 41/0007; F02D 2041/0017; F02D 2041/001;
(Continued)

(56) References Cited

U.S. PATENT DOCUMENTS 6,917,874 B2 7/2005 Uchida et al.
7,181,332 B1 * 2/2007 Vick ..... F02D 41/1445 123/316

(Continued)

FOREIGN PATENT DOCUMENTS

EP 1662118 A1 5/2006
FR 3057302 A1 4/2018

OTHER PUBLICATIONS

Search Report for Italian Patent Application No. 201900006862 dated Jan. 21, 2020.

(Continued)

*Primary Examiner* — Hai H Huynh
(74) *Attorney, Agent, or Firm* — Howard & Howard Attorneys PLLC

(57) ABSTRACT

A method for determining the mass m of air trapped in each cylinder of an internal combustion engine comprises determining, a value for each quantity of a first group of reference quantities comprising at least intake pressure P measured inside the intake manifold, engine rotation speed n, mass of gases produced by the combustion in the previous operating cycle (OFF) and present in the cylinder, determining, the actual inner volume V of each cylinder as a function of the engine rotation speed n, of the lift H of the intake valve and of the closing delay angle IVC of the intake valve, and determining the mass m of air trapped in each cylinder as a function of the first group of reference quantities and of the actual volume V inside each cylinder, on the basis of the aforesaid quantities P, V, OFF.

38 Claims, 6 Drawing Sheets

(52) U.S. Cl.
CPC ..... *F02D 2041/001* (2013.01); *F02D 2041/0017* (2013.01); *F02D 2200/0406* (2013.01); *F02D 2200/0414* (2013.01); *F02D 2200/101* (2013.01)

(58) Field of Classification Search
CPC ..... F02D 2200/0414; F02D 2200/0406; F02D 2200/101; F02M 26/47
USPC ..... 123/90.11, 90.15, 399; 73/114.32, 73/114.33, 114.34, 114.35; 701/103
See application file for complete search history.

(56) References Cited

U.S. PATENT DOCUMENTS

| | | | | |
|---|---|---|---|---|
| 7,588,001 | B2 * | 9/2009 | Branyon | F02B 33/22 123/70 R |
| 8,235,012 | B2 | 8/2012 | Kang et al. | |
| 9,739,217 | B2 * | 8/2017 | Burkhardt | F02D 33/006 |
| 2018/0113963 | A1 * | 4/2018 | Kordon | G05B 17/02 |

OTHER PUBLICATIONS

Leroy, T., et al., "Modeling Fresh Air Charge and Residual Gas Fraction on a Dual Independent Variable Valve Timing SI Engine," SAE Int. J. of Eng., vol. 1, No. 1, pp. 627-635 (Apr. 14, 2008).

* cited by examiner

METHOD FOR ESTIMATING AND CONTROLLING THE INTAKE EFFICIENCY OF AN INTERNAL COMBUSTION ENGINE

CROSS-REFERENCE TO RELATED APPLICATIONS

The present application claims priority to and all the benefits of Italian Patent Application No. 102019000006862, filed on May 15, 2019, which is hereby expressly incorporated herein by reference in its entirety.

BACKGROUND OF THE INVENTION

1. Field of the Invention

The present invention relates to a method, implemented by electronic processing, for estimating and controlling the intake efficiency of an internal combustion engine.

In particular, the invention relates to a method for determining the mass of air trapped in each cylinder of an internal combustion engine and to a method for controlling and implementing the operation of at least one cylinder of an internal combustion engine.

2. Description of the Related Art

As known, an internal combustion engine supercharged through a turbocharger supercharging system comprises a plurality of injectors which inject the fuel into respective cylinders, each of which is connected to an intake manifold through at least one corresponding intake valve and to an exhaust manifold through at least one corresponding exhaust valve.

The intake manifold receives a gas mixture which comprises both exhaust gas and fresh air, i.e., air from the outside environment through an intake duct, provided with an air cleaner for the flow of fresh air and regulated by a throttle valve. An air flow meter is also arranged along the intake duct, preferably downstream of the air cleaner.

The air flow meter is a sensor connected to an electronic control unit and designed to detect the flow rate of fresh air sucked in by the internal combustion engine. The fresh air flow rate sucked in by the internal combustion engine is an extremely important parameter for the engine control, in particular, to determine the amount of fuel to be injected into the cylinders to obtain a given air/fuel ratio in an exhaust duct downstream of the exhaust manifold.

Typically, however, the air flow meter is a very expensive and also quite delicate component, because oil vapors and dust can foul it, thus altering the reading of the fresh air flow rate value sucked in by the internal combustion engine.

The need has therefore arisen to determine the fresh air flow rate sucked in by the internal combustion engine (i.e., the mass trapped in each cylinder) possibly avoiding the use of the air flow meter, but maintaining high accuracy, in line with the performance requirements of this technical sector.

The known solutions, in this regard, do not meet the above-mentioned requirements, in particular in the field of internal combustion engines in which VVH (Variable Valve Height) control techniques are applied, or where both VVH and VVT (Variable Valve Timing) techniques are applied.

SUMMARY OF THE INVENTION

It is the object of the present invention to provide a method for determining the air mass trapped in each cylinder of an internal combustion engine, which allows solving at least in part the drawbacks described above with reference to the prior art and to respond to the aforesaid needs particularly felt in the considered technical sector.

Such an object is achieved through a method for determining the mass (m) of air trapped in each cylinder of an internal combustion engine comprising a number of cylinders, wherein each of the cylinders is connected to an intake manifold from which it receives fresh air through at least one respective intake valve, and to an exhaust manifold into which it introduces the exhaust gases generated by the combustion through at least one respective exhaust valve. The intake valve is driven so as to vary the lift (H) of the intake valve in controlled manner, the method comprising the steps of: determining, based on a filling model using measured and/or estimated physical quantities, a value for each quantity of a first group of reference quantities comprising intake pressure (P) measured inside the intake manifold, engine rotation speed (n), mass of gases produced by the combustion in the previous operating cycle (OFF) and present inside the cylinder estimated as a function of said lift (H) and on the closing delay angle (IVC) of the intake valve depending on said lift (H); determining, based on said filling model, the effective inner volume (V) of each cylinder as a function of said engine rotation speed (n), of said lift (H) of the intake valve and of said closing delay angle (IVC) of the intake valve; and determining the mass (m) of air trapped in each cylinder as a function of the first group of reference quantities and of the actual volume (V) inside each cylinder, through the relation:

$$m=(P*V)-\mathrm{OFF}.$$

Further embodiments of such a method are also disclosed herein.

The present invention is also directed toward a method for controlling and implementing the operation of at least one cylinder of an internal combustion engine.

Other objects, features and advantages of the present invention will be readily appreciated as the same becomes better understood after reading the subsequent description taken in connection with the accompanying drawings.

DETAILED DESCRIPTION OF THE INVENTION

Figure 1:
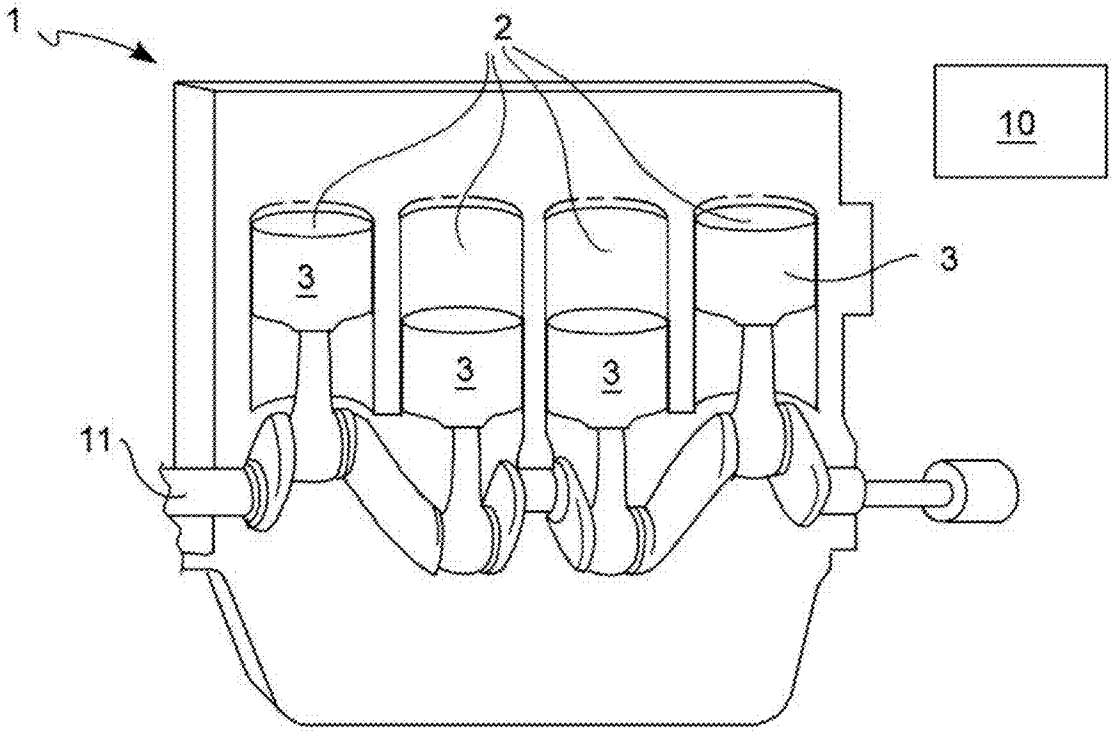
FIG. 1 diagrammatically illustrates a preferred embodiment of an internal combustion engine provided with an electronic control unit which implements a method according to the present invention.

Before describing the method, an example of engine 1 in which the method according to the invention can be applied is described below in a diagrammatic and simplified manner for the sake of clarity of illustration, with reference to FIGS. 1 and 2. Engine 1 is an internal combustion engine.

Preferably, such engine 1 is an internal combustion engine supercharged by use of a turbocharger supercharging system.

Engine 1 comprises a given number of injectors which inject fuel into their respective cylinders 2 (e.g., four cylinders, preferably arranged in line); typically, a corresponding injector is provided for each cylinder 2. Each of the cylinders 2 is connected to an intake manifold 4 through at least one respective intake valve 5 and to an exhaust manifold 6 through at least one respective exhaust valve 7. According to several possible implementation options, the injection may be of the indirect type (in which each injector is placed upstream of the respective cylinder in an intake pipe connecting the intake manifold to the cylinder), or it can be of the direct type (in which each injector is partially placed inside the cylinder).

Each cylinder 2 comprises a respective piston 3 mechanically connected through a connecting rod to a drive shaft 11 for transmitting the force generated by the combustion in the cylinder 3 to the drive shaft 11 (in a manner known in itself).

The intake manifold 4 receives a gas mixture which comprises both exhaust gas and fresh air, coming from the outside environment through an intake duct 8, which is preferably provided with an air cleaner for the flow of fresh air and regulated by a throttle valve 12, preferably movable between a closed position and a maximum open position. In the solution illustrated here, no air flow meter is provided along the intake line 8.

The position of each exhaust valve 7 and the position of each intake valve 5 are controlled, for example, by the respective camshafts which receive the motion of the drive shaft 11.

An intercooler, which may be integrated into intake manifold 4 and which performs the function of cooling the intake air, is placed along the intake duct 8. An exhaust duct 9 is connected to the exhaust manifold 6, wherein the exhaust duct 9 feeds the exhaust gases produced by the combustion to an exhaust system, which emits the gases produced by combustion into the atmosphere. The exhaust system typically comprises a catalytic converter and, downstream of this, a muffler.

The supercharging system of the internal combustion engine 1 comprises a turbocharger provided with a turbine, which is arranged along the exhaust pipe 9 to rotate at high speed under the bias of the exhaust gases expelled from the cylinders 3, and a compressor, which is arranged along the intake duct 8 and is mechanically connected to the turbine to be rotatably fed by the turbine itself, to increase the air pressure in the intake duct 8.

In the description above, reference has been made to an internal combustion engine 1 supercharged through a turbocharger. Alternatively, the method of the present invention may be advantageously applied to any internal combustion engine, According to another example, the method can be applied to an internal combustion engine supercharged through a dynamic or volumetric compressor.

A Variable Valve Height (VVH) control is performed in the internal combustion engine 1, considered here.

Such VVH control is carried out through a VVH device or VVH actuator, which is known in itself (e.g., of the META or VALVTRONIC type, to mention solutions well known to the person skilled in the industry). The VVH actuator is symbolically indicated as a block by the reference numeral 50 in FIG. 2.

The VVH actuator allows continuously varying the lift law of the intake valve. Typically, every possible lift value H (which can be set by the VVH actuator) also implies a corresponding value of the opening advance and a corresponding value of the closing delay of the intake valve.

As will be illustrated in greater detail below, the VVH actuator comprises, for example, an intake valve lift shifter which can modify the lift law, starting from the maximum lift profile and determining a different profile, with reduced lift H and width, i.e., delaying the opening and anticipating the closing of the intake valve. Typically, the variable speed drive of the valve lift acts through specific mechanical/geometric properties, and has a degree of freedom $\gamma$, corresponding to a position of the variable speed drive/actuator, which is in a one-to-one correspondence with the lift $H(\gamma)$.

The internal combustion engine 1 is controlled by an electronic control unit 10, which governs the operation of all the components of the internal combustion engine 1. In particular, the electronic control unit 10 is connected to a plurality of sensors, e.g. sensors which measure temperature and pressure along the intake duct 8 upstream of the compressor; sensors which measure temperature and pressure along intake duct 8 upstream of the throttle valve 12; sensors which measure temperature T and pressure P of the gas mixture present in the intake manifold 4.

Furthermore, the electronic control unit 10 can be connected to a sensor which measures the angular position of the drive shaft 11, and thus the rotation speed n of the engine (i.e., for example, the number of revolutions per minute, rpm, of the engine).

Furthermore, the electronic control unit 10 can be connected to a sensor which measures the air/fuel ratio of the exhaust gases upstream of the catalytic converter (for example, a linear oxygen probe of type UHEGO or UEGO, which is known in itself and not described in detail here) and a sensor which measures the intake valve phase and/or the exhaust valve phase.

Figure 2:
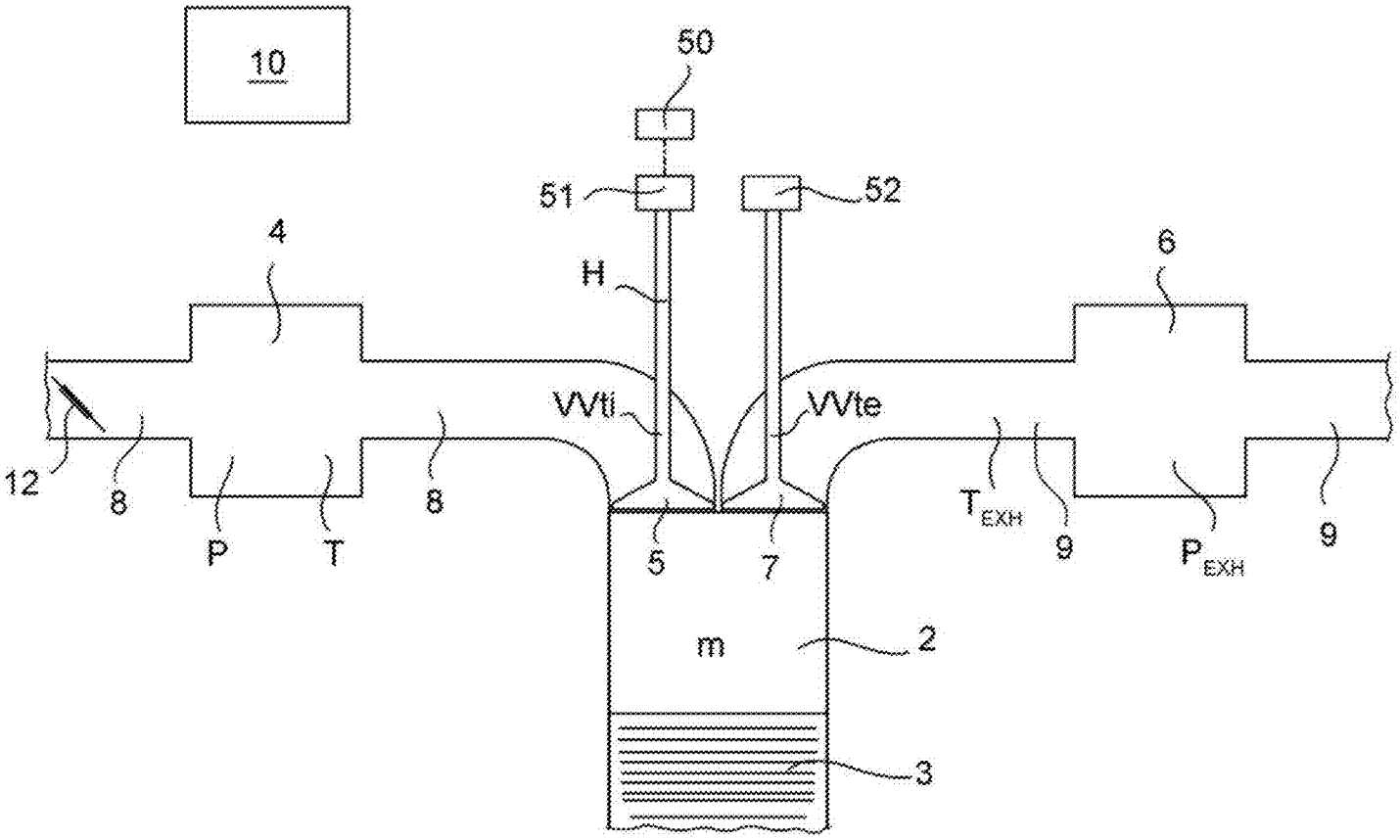
FIG. 2 illustrates a cylinder of the engine in FIG. 1 in greater detail.

Some of the aforesaid sensors are diagrammatically shown as dark circles, in FIG. 2, each named as the variable that it can detect.

The aforementioned "filling model" or calculation model, through which, inter alia, the mass m of air trapped in each cylinder 2 (for each cycle) and the mass $M_{TOT}$ of air sucked in by the internal combustion engine 1 is determined, is stored in the electronic control unit 10.

It is worth noting that, as shown above, the electronic control unit 10 is operationally connected to all the actuators (e.g., to the blocks indicated in FIG. 2 by reference numerals 50, 51, 52) and to all the sensors (e.g., to the blocks indicated in FIG. 2 by references P, T, VVti, VVte, H, $T_{EXH}$, $P_{EXH}$) of all the engine cylinders. These obvious links are not shown in FIGS. 1 and 2, which privilege the clarity of illustration of other aspects.

With reference to the FIGS. 1-7, a method for determining the mass m of air trapped in each cylinder 2 of an internal combustion engine 1 comprising a number of cylinders 2 is now described. Each cylinder 2 is connected to an intake manifold 4, from which it receives fresh air through at least one respective intake valve 5, and to an exhaust manifold 6, into which it introduces the exhaust gases produced by combustion through at least one respective exhaust valve 7. The at least one intake valve 5 is driven to vary the lift H of the intake valve 5 in a controlled manner.

The method firstly comprises the step of determining a value for each quantity of a first group of reference quantities on the basis of a filling model using measured and/or estimated physical quantities.

Such first group of reference quantities comprises: intake pressure P measured inside the intake manifold 4; engine rotation speed n; mass of gases produced by the combustion in the previous operating cycle (OFF) and present in the cylinder 2 estimated a function of the aforesaid lift H and of the closing delay angle IVC of the intake valve depending on the aforesaid lift H.

The method then provides determining, based on the aforesaid filling model, the actual inner volume V of each cylinder 2 as a function of said engine rotation speed n, of the aforesaid lift H of the intake valve and of the aforesaid closing delay angle of the intake valve IVC.

The method finally provides determining the mass m of air trapped in each cylinder 2 as a function of the first group of reference quantities and of the actual volume V inside each cylinder 2, through the following relation:

$$m=(P*V)-\mathrm{OFF} \quad [1].$$

According to a preferred option of implementation, the aforesaid "filling model" or calculation model, which allows determining, inter alia, the mass m of air trapped in each cylinder 2 (for each cycle) is stored in the electronic control unit 10.

According to an embodiment (shows in the diagram reported in FIG. 3), the method further comprises the step of driving the intake valve 5 using an intake valve lift shifter 50 by varying the law of lift of the intake valve in controlled manner so as to define both the lift H, and the opening advance angle of the intake valve IVO and the closing delay angle of the intake valve IVC according to a single degree of freedom γ.

According to an implementation option of this embodiment, the aforementioned step of driving comprises determining the intake valve opening advance angle IVO using the relation:

$$IVO(H)=IVO_{hmax}-\Delta ivo(H) \quad [2],$$

where $IVO_{hmax}$ is the intake valve opening advance angle corresponding to the maximum lift (indicated as $H_{max}$ in FIG. 3), and Δivo(H) is a variation of intake valve opening advance angle depending on the controlled lift H.

Furthermore, the aforesaid step of driving comprises determining the intake valve closing delay angle IVC using the relation $$IVC(H)=IVC_{hmax}-\Delta ivc(H) \quad [3],$$

where $IVC_{hmax}$ is the intake valve closing delay angle corresponding to the maximum lift $H_{max}$, and Δivc(H) is a variation of intake valve closing delay angle depending on the controlled lift H.

The aforesaid quantities dependent on the lift H (IVO(H), IVC(H), Δivo(H), Δivc(H)) also depend on the aforesaid degree of freedom γ, because, as noted above, H depends on γ.

Figure 3:
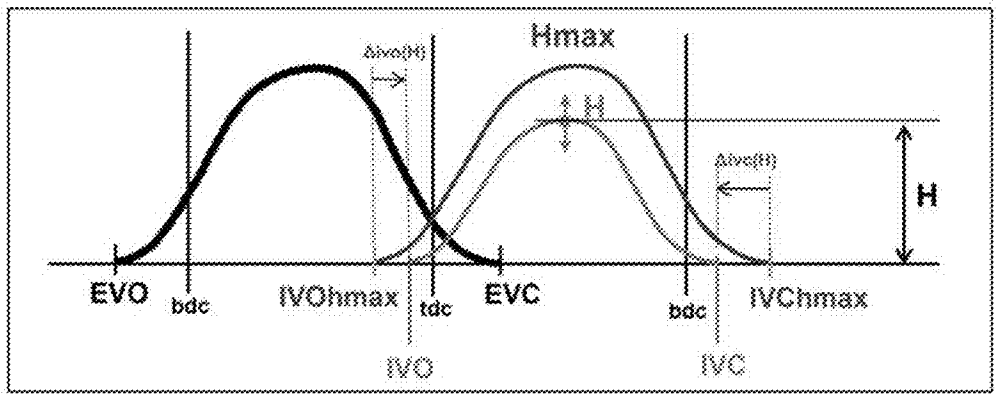
FIGS. 3-5 are diagrams which represent the opening and closing laws of the exhaust valve (curve on the left side) and of the intake valve (curve on the right side) in VVH lift control only, VVT timing control only, and simultaneous VVH lift control and VVT timing control application conditions, respectively.
Figure 4:
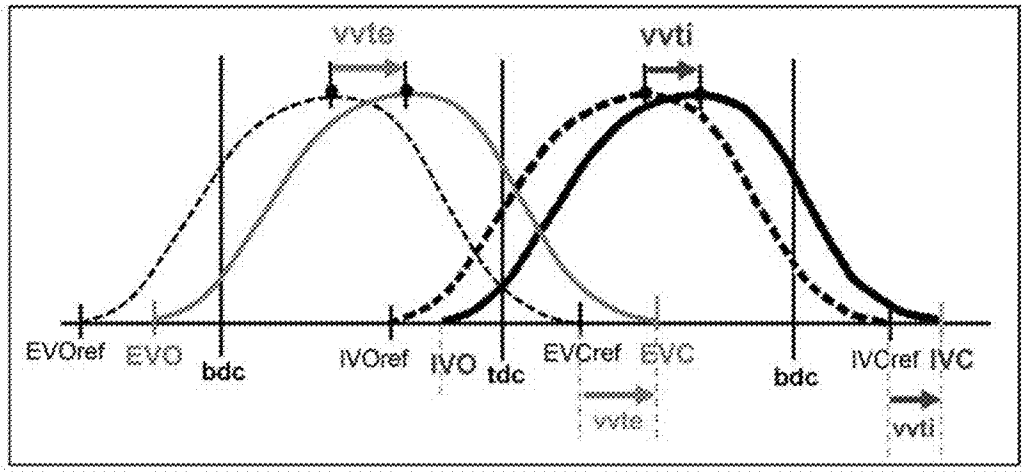

In FIG. 3, references "bdc" and "tdc" indicate the bottom dead center and the top dead center, respectively.

According to an implementation option, the degree of freedom γ is related to the position of the VVH actuator.

According to an embodiment, the method applies to an internal combustion engine 1 in which a variable valve timing (VVT) control is also performed. Therefore, this embodiment works in the presence of both VVH and VVT controls.

In such a case, the intake valve 5 and/or exhaust valve 7 are driven by a VVT device, or a VVT actuator, or a VVT phase shifter, which, for example, acts hydraulically on the shaft which drives the intake valves 5 and/or exhaust valves 7, modifying the timing with respect to a drive shaft.

In particular, according to an embodiment of the method considered here, the at least one intake valve 5 is further driven to vary the intake valve angular displacement VVTi in controlled manner, and/or the at least one exhaust valve 7 is driven to vary the exhaust valve angular displacement VVTe in a controlled manner.

The step of determining a value for a first group of reference quantities comprises determining the closing delay angle IVC of the intake valve based on both the lift H of the intake valve and the displacement of the intake valve VVTi.

In this description, the term "VVTi intake valve displacement (or displacement angle)" is used to indicate an angular amplitude of a deviation, equal to the angular position variation of the VVTi intake actuator referred to the engine (crank) angle, with respect to the reference values of the intake valve to which a zero VVTi corresponds.

Similarly, the term "VVTi exhaust valve displacement (or displacement angle)" is used to indicate an angular amplitude of a deviation, equal to the angular position variation of the VVTe exhaust actuator referred to the engine (crank) angle, with respect to the reference values of the exhaust valve to which a zero VVTe corresponds.

As noted above, the displacement, therefore, refers to a variation in the position of the VVT actuator.

According to an implementation option of this embodiment, the method further comprises the steps of driving the intake valve 5 by an intake valve phase shifter 51 by varying in a controlled manner the displacement of intake valve VVTi, so that both the intake valve opening advance angle IVO and the intake valve closing delay angle IVC depend not only on the lift H but also on the displacement of intake valve VVTi; and drive the exhaust valve 7 by an exhaust valve phase shifter 52 by varying the VVTe exhaust valve displacement in a controlled manner, so that both the exhaust valve opening advance angle EVO and the exhaust valve closing delay angle EVC depend on the displacement of the exhaust valve timing VVTe.

More in detail, the aforesaid step of driving comprises determining the intake valve opening advance angle IVO using the relation:

$$IVO(H)=IVO_{ref}-\Delta ivo(H)-VVTi \quad [4],$$

where $IVO_{ref}$ is a reference value of the intake valve opening advance angle in the absence of phase shifting, VVTi is the displacement angle of the intake valve phase shifter 51 with respect to a respective reference position corresponding to the aforesaid reference value $IVO_{ref}$.

The step of driving further comprises determining the closing delay angle of the intake valve IVC using the relation:

$$IVC(H)=IVC_{ref}-\Delta ivc(H)+VVTi \quad [5],$$

where $IVC_{ref}$ is a reference value of the closing delay angle of the intake valve in the absence of phase shifting.

The step of driving further comprises determining the exhaust intake valve opening delay angle EVO through the relation:

$$EVO=EVO_{ref}-VVTe \quad [6],$$

where $EVO_{ref}$ is a reference value of the exhaust valve opening advance angle in the absence of phase shifting and VVTe is the displacement angle of the exhaust valve phase shifter 52 with respect to a respective reference position indicated by the aforesaid reference value $EVO_{ref}$.

The step of driving further comprises determining the exhaust valve closing delay angle EVC using the relation:

$$EVC=EVC_{ref}+VVTe \quad [7],$$

where $EVC_{ref}$ is a reference value of the exhaust valve closing delay angle in the absence of phase shifting.

Since the VVT control varies the timing of the intake valves 5 and of their intersection with the exhaust valves 7 (the intersecting step is the step during which the intake valve 5 and the exhaust valve 7 are open simultaneously), the filling model further comprises the knowledge of the aforesaid parameters. Such parameters (shown in FIG. 4 with respect to the top dead center TDC and the bottom dead center BDC) are summarized below:

IVCref reference closing angle of the exhaust valve 5;

IVOref reference opening angle of the intake valve 5;

EVCref reference closing angle of the exhaust valve 7;

EVOref reference opening angle of the exhaust valve 7;

IVC closing delay angle of the intake valve 5;

IVO opening advance angle of the intake valve 5;

EVC closing delay angle of the exhaust valve 7;

EVO opening advance angle of the exhaust valve 7.

As already noted, the displacement angles VVTi and VVTe can also be defined as:

VVTi: angular width of the opening or closing deviation with respect to the reference values of the intake valve 5, equal to the phase variation of the intake actuator VVT;

VVTe: angular width of the opening or closing deviation with respect to the reference values of the exhaust valve 7, equal to the phase variation of the exhaust actuator VVT.

Figure 5:
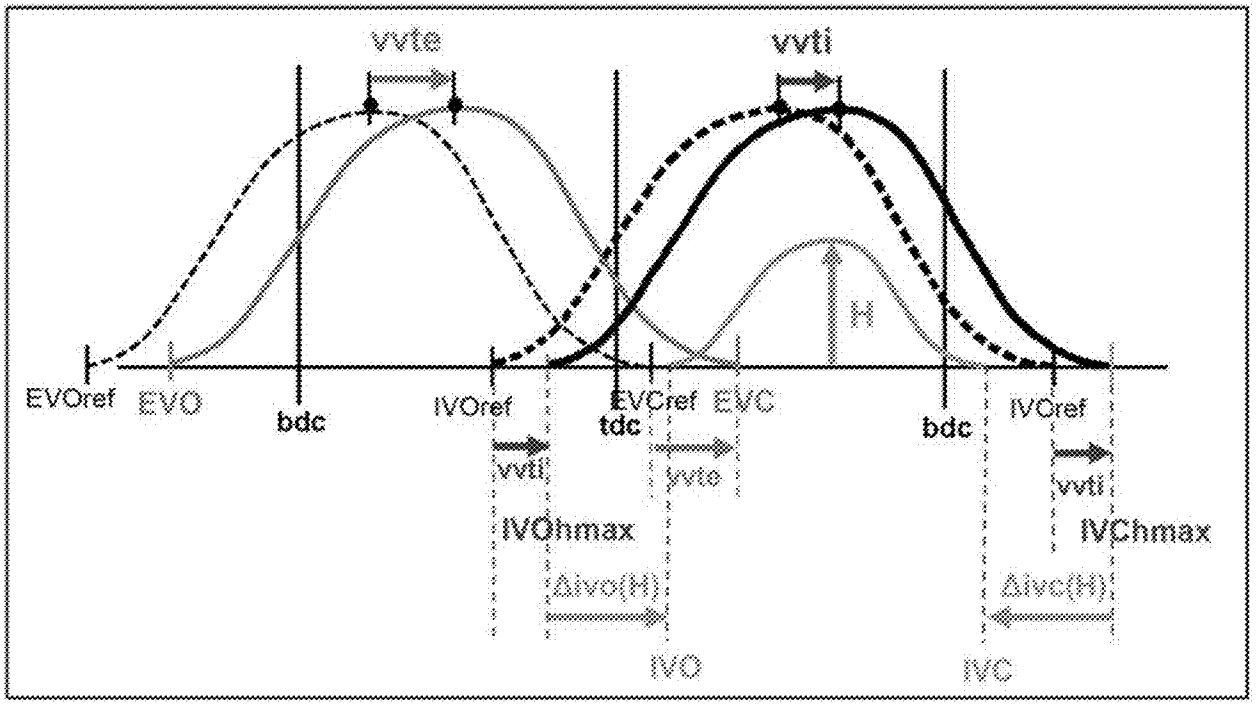

The combined action of VVT and VVH controls, and the respective parameters, are shown in FIG. 5.

Considering now the step of determining the actual internal volume V of the cylinder 2, it is worth noting that such volume V is geometrically variable a function of the closing delay angle IVC of the respective intake valve: V=f(IVC). Indeed, the actual internal volume V of the cylinder 2 is given by the sum of the volume of the combustion chamber $V_{CC}$ of the cylinder 3 and of the volume $V_c$ swept by the respective piston 3 until the closing of the respective intake valve 5 (i.e., the rotation angle of the crank in relation to the top dead center PMS).

The kinematic law used to calculate the effective internal volume V of cylinder 2 at crank angle α is given below, without providing further details (since it is well known in literature): $V(\alpha)=V_{CC}+V_C(\alpha)$, which becomes, after making $V_C(\alpha)$ explicit:

$$V(\alpha)=VCC+S*r*[(1+1/\lambda)*(1-(\delta/(1+\lambda)^2)^{1/2}-\cos\alpha-1/\lambda*(1-(\lambda*sen\alpha-\delta)^2)^{1/2}] \quad [8],$$

where V is the actual internal volume of the cylinder; $V_{CC}$ is the volume of the combustion chamber of the cylinder; α is the angle of rotation of the crank relative to top dead center PMS; r is crank radius; L is the length of the connecting rod; S is the surface of the piston; d is the offset between the axis of the cylinder and the axis of rotation of the drive shaft; λ indicates the ratio r/L; δ indicates the ratio d/L.

In general, the volume to be used for cylinder filling calculation is a function of intake valve closing delay angle IVC, intake valve lift H, engine rotation speed n, intake pressure P.

The Applicant, based on experiments and calculations, has identified the following manners to express the aforesaid dependence (defined above in a very general manner, and not very useful operationally) in a more effective manner, such as to constitute a good approximation and to allow a simpler calibration of the model.

According to an embodiment of the method, the step of determining the actual internal volume V of each cylinder comprises calculating the actual internal volume V of each cylinder 2 using a first map $f_v(IVC,n)$, a second map $f_h(H,n)$ and a third map $f_p(P,n)$.

The first map $f_v(IVC,n)$ is a function of the closing delay angle of the intake valve IVC and of the engine rotation speed n.

The second map $f_h(H,n)$ is a function of the intake valve lift H and of the engine rotation speed n.

The third map $f_p(P,n)$ is a function of the intake pressure P and of the engine rotation speed n.

According to a more specific option of implementation, the actual internal volume V of each cylinder 2 is calculated by the relation:

$$V=f_v(IVC,n)*f_h(H,n)*f_p(P,n) \quad [9].$$

It should be noted that, according to an implementation option, the actual volume V (which can also be defined as "effective volume V"), calculated and used in the method, incorporates a dimensional constant which makes the product P*V to dimensionally correspond to a mass. In other terms, the actual volume V is the product of the volume measured in volume units (e.g., $cm^3$) and a dimensional constant, whose value is taken into account, in a consistent way, in all the used formulae.

It is now consider a further possible refinement of the calculation of the air mass trapped in the cylinder, which also takes into account temperature parameters.

According to an embodiment of the method, the aforesaid first group of reference quantities further comprises the temperature T detected inside the intake manifold 4 and the temperature $T_{H2O}$ of the coolant fluid of the engine, The step of determining the mass m of air trapped in each cylinder 2 comprises calculating the mass m of air trapped in each cylinder 2 as a function of the first group of reference quantities and the actual volume V inside each cylinder 2, through the relation:

$$m=[(P*V)-\mathrm{OFF}]*f_1(T,P)*f_2(T_{H2O},P) \quad [10],$$

where $f_1(T, P)$ and $f_2(T_{H2O}, P)$ are known functions belonging to the aforesaid filling model.

The aforesaid embodiment is based on the following considerations. The filling model starts from the well-known ideal gas law, from which it is derived:

$$m=(P*V)/(R*T) \quad [11],$$

where P is the average pressure measured for the engine cycle in the intake manifold; T is the temperature of the fresh air and/or exhaust gas mix in the intake manifold 4; R is the gas constant, equal to 287 [J/kg*K] for ideal gases; V is the internal volume of the cylinder when the respective intake valves 5 and exhaust valves 7 are closed.

The ideal gas law [11] is adapted experimentally for the filling model by incorporating the constant R of the fresh air and/or exhaust gas mix so that the mass m of air trapped in each cylinder 2 for each cycle is expressed as: $m=P*V*f_1(T, P)*f_2(T_{H2O}, P)$, where $T_{H2O}$ is the temperature of engine 1, i.e., the temperature of the coolant fluid of engine 1.

Then, the ideal gas law is further adapted experimentally, for the filling model, so that the calculation of the mass m of air trapped in each cylinder 2 for each cycle takes into account the gases produced by the combustion in the previous working cycle and present in the cylinder (either because they did not escape from the cylinder 3 itself or because they are sucked back into the cylinder), thus obtaining the aforesaid formula [10], where OFF is a variable (mass) which takes into account the gases produced by combustion in the previous working cycle and present in the cylinder 2.

Experiments are performed at reference values of temperatures T and $T_{H2O}$ to calibrate the filling model. For example, the reference temperature T can be chosen as 40° C., the temperature $T_{H2O}$ can be chosen as 90° C. At such reference temperatures (used for calibration) the above functions $f_1$ and $f_2$ assume a value of 1.

Embodiments of the method applicable to engines capable of operating under internal exhaust gas recirculation (EGRi) and/or scavenging conditions are described below. Such operating conditions are known, as are the devices and features (not further described here) which allow an internal combustion engine to operate under the above conditions.

It must be considered that, at the beginning of the intake phase of any engine cycle, residual combustion gases from the previous engine cycle are also present in the cylinder 2.

Geometrically, the volume occupied by the residual combustion gases from the previous engine cycle, i.e. "dead volume", can be expressed as the sum of the nominal geometric volume of the cylinder combustion chamber and a volume $V_C$ swept by the respective piston inside the cylinder.

This "dead volume" is a sort of "actual combustion chamber volume", and will be called below "combustion chamber volume $V_{cc}$" for the sake of simplicity. From a geometrical point of view, such a volume can be related to the angle of rotation of the crank a using the aforesaid formula [8].

The volume $V_C$ swept by the piston 3 inside the cylinder 2 is variable, according to possible different operating conditions, which can be described through a parameter TVC, which will be better illustrated later.

In particular, according to different possible variants, the volume $V_C$ swept by the piston inside the cylinder corresponds:

to the volume swept by the piston up to the closing instant of the exhaust valve 7, if the intake valve 5 opens after the exhaust valve 7 closes; or to the volume swept by the piston up to the opening instant of the intake valve 5, if the exhaust valve 7 closes after the opening of the intake valve 5; or to the volume swept by the piston up to top dead center PMS, if the opening instant of the intake valve 5 precedes top dead center PMS; in such a case, the volume $V_C$ swept by the piston inside the cylinder is zero, and the actual internal volume V of the cylinder corresponds exactly to the volume $V_{CC}$ of the combustion chamber of the cylinder.

Given the aforesaid possible cases, the parameter TVC may alternatively correspond to different values (different angles), as described below.

According to an embodiment, applicable in the case in which the engine 1 operates in internal exhaust gas recirculation condition EGRi, the method comprises the further step of calculating the volume of the combustion chamber $V_{cc}$ (i.e. the volume $V_{cc}$ occupied by the residual combustion gases of the previous engine cycle) of cylinder 2 based on a fourth map $f_e$(TVC, n) which is a function of a first TVC parameter and engine rotation speed n, a fifth map ge(OVL, n) which is a function of a second parameter OVL and of the engine rotation speed n, and of a sixth map he(H, n) which is a function of the lift H and of the engine rotation speed n.

The aforesaid first parameter TVC is alternatively equal to the closing delay angle EVC of the exhaust valve 7 or to the maximum between zero and the minimum value among the closing delay angle EVC of the exhaust valve 7 and the value of the opening advance angle IVO of the intake valve 5 multiplied by −1.

The aforesaid second parameter OVL is representative of the duration of the intersecting step between the intake and exhaust curves (in which the intake and exhaust valves are open at the same time) and is defined as the sum of the exhaust valve closing delay angle EVC and of the intake valve opening advance angle IVO.

Figure 6:
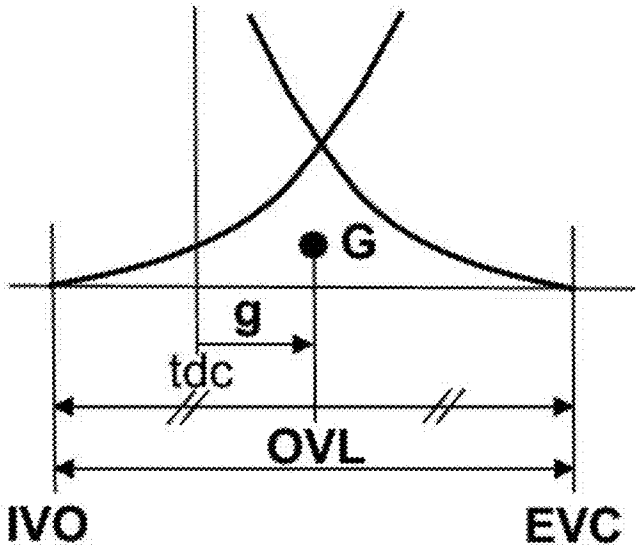
FIG. 6 diagrammatically illustrates the intersecting step of an intake valve and an exhaust valve of the engine in FIG. 1.
Figure 7:
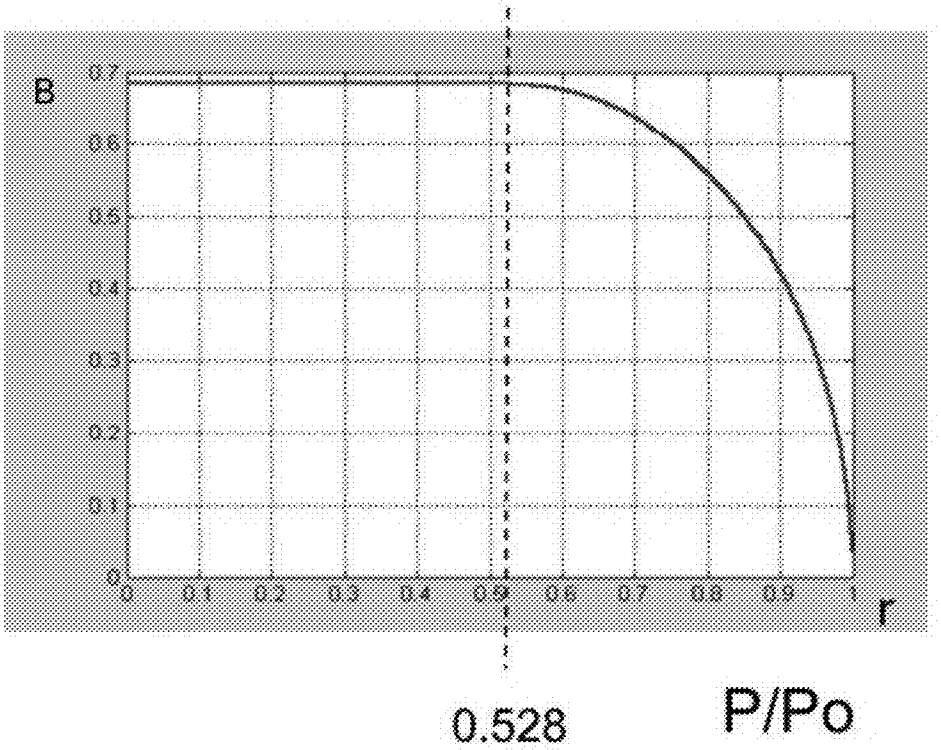
FIG. 7 shows a known law of the trend of a compression factor of an isoentropic flow through an orifice of radius r, as a function of the relation between the pressures after and before the orifice.

The parameter OVL is shown in the diagram in FIG. 6.

According to a more specific option of implementation, the aforesaid volume of the combustion chamber $V_{cc}$ is calculated using the formula:

$$V_{cc}=f_e(TVC,n)*g_e(OVL,n)*h_e(H,n) \quad [12],$$

where $f_e$, $g_e$, $h_e$ are known functions belonging to the aforesaid filling model.

According to another embodiment, applicable in the case in which engine 1 operates in a scavenging condition (SCAV) in which the intake pressure is greater than the exhaust pressure, resulting in fresh air intake which carries away residual exhaust gases from the combustion chamber, the method comprises the further step of calculating the volume of the combustion chamber $V_{cc}$ of cylinder 2 on the basis of a fourth map $f_s$(TVC,n) which is a function of a first parameter TVC and of the engine rotation speed n, a fifth map $g_s$(OVL,n) which is a function of a second parameter OVL and of the engine rotation speed n, and a sixth map $h_s$(H,n) which is a function of the lift H and of the engine rotation speed n.

In such a case, the aforesaid first parameter TVC is alternatively equal to the closing delay angle EVC of the exhaust valve 7 or to the maximum between zero and the minimum value among the closing delay angle EVC of the exhaust valve 7 and the value of the opening advance angle IVO of the intake valve 5 multiplied by −1, In such a case, the aforesaid second parameter OVL is representative of the duration of the intersecting step between the intake and exhaust curves and is defined as the sum of the exhaust valve closing delay angle EVC and the intake valve opening advance angle EVC, i.e. OVL=EVC+IVO.

According to a more specific option of implementation, the aforesaid volume of the combustion chamber $V_{cc}$ is calculated using the formula:

$$V_{cc}=f_s(TVC,n)*g_s(OVL,n)*h_s(H,n) \quad [13],$$

where $f_s$, $g_s$, $h_s$ are known functions belonging to the aforesaid filling model.

According to a further embodiment, the method provides the further step of calculating the mass of the gaseous flow $M_{OVL}$, which flows through the intersecting step, i.e., through the intake valve 5 and the exhaust valve 7, in the case of exhaust gas internal recirculation EGRi or of scavenging SCAV, on the basis of the following relation:

$$M_{OVL}=\text{PERM}*\beta(P/P_0,n)*P_0/P_{0_REF}*(T_{0_REF}/T_0)^{1/2}/n \quad [14],$$

where PERM is the hydraulic permeability of the intersection; n is the engine rotation speed; $P_{0_REF}$ is a reference pressure upstream of the passage section or intersection; $T_{0_REF}$ is a reference temperature upstream of the passage section or intersection; $T_0$ is the temperature measured upstream of the passage section or intersection.

$\beta(P/P_0,n)$ is a compression factor of a flow through an orifice, depending on the ratio between the pressures downstream and upstream of the orifice and on the engine speed (n); in the isoentropic case only the ratio between the upstream and downstream pressures P/Po are known.

$P_0$ is the exhaust pressure and P is the intake pressure, in a condition of internal exhaust gas recirculation.

Alternatively, under a condition of scavenging, $P_0$ is the intake pressure and P is the exhaust pressure.

According to a more specific option of implementation, the aforesaid hydraulic permeability intersection PERM is calculated by the following relation:

$$PERM=A(OVL,n)*fo(H,n)*G(g,n) \quad [15].$$

A(OVL,n) is a first function depending on the engine speed n and on the duration of the intersecting step OVL during which the intake valve 5 and the exhaust valve 7 are simultaneously opened;

fo(H,n) is a second function dependent on the lift H and the engine speed n.

G (g,n) is a third function, representative of the center of gravity of the intersection region (i.e. of the intersecting step between each intake valve 5 and the respective exhaust valve 7), dependent on the engine speed n and a geometric parameter g. The geometric parameter g is representative of the angular deviation between the top dead center PMS and the aforesaid center of gravity G.

The parameters G and g are shown in FIG. 6.

The offset of the intersection from top dead center PMS can be expressed by the parameter g, as:

$$g=(EVC-IVO)/2.$$

For illustrative purposes only, the law (known in literature, and therefore not described in detail) used to calculate the mass flow rate M through a section of a duct (or through an orifice) used to determine the aforesaid mass MOVL is shown below:

$$M=CD*A*P0/(R/T0)^{1/2}*B(P/P0) \quad [16],$$

where A is the area of the passage section; CD is an outflow coefficient; P is the pressure downstream from the passage section; P0 is the intake pressure of the passage section; T0 is the intake temperature to the duct section; R is the gas constant referred to the fluid which flows in the duct section; B is a compressible flow function, known in itself (illustrated for example in FIG. 7).

The formula [16] is experimentally adapted for the filling model by integrating it between the beginning instant $t_1$ of the intersecting step and the end instant $t_2$ of the intersecting step, according to the relation:

$$\dot{m} = P_0/(R/T_0)^{1/2} * B(P/P_0) * \int_{t_1}^{t_2} A_{IS}(t)dt,$$

where $A_{IS}$ represents the isentropic area.

Replacing the variable dt with dθ/ω (in which θ is the motor angle and co is the motor rotation speed) gives the following relation:

$$\dot{m}=P_0/(R/T_0)^{1/2}*B(P/P_0)*\int A_{IS}(\theta)*(1/\omega)d\theta.$$

Finally, assuming that the rotation speed co of the internal combustion engine 1 is constant during the intersecting step, the previous relation can be simplified as follows:

$$\dot{m}=P_0/(R/T_0)^{1/2}*B(P/P_0)*(1/\omega)*\int A_{IS}(\theta)d\theta$$

According to an embodiment, applicable to a condition of exhaust gas internal recirculation EGRi wherein the exhaust pressure $P_{EXH}$ is greater than the intake pressure P, the method comprises the further step of: calculating the total mass $M_{EGRi}$ of gas present in the cylinder as the sum of an estimated mass $M_{EXH_EGR}$ of exhaust gases in the combustion chamber under conditions of exhaust gas internal recirculation and of the aforesaid estimated mass of gaseous flow $M_{OVL}$ which flows through the intersecting step, i.e. the mass of gaseous flow which flows from the exhaust to the intake through the intake valve 5 and the exhaust valve 7 and which is then sucked back into the cylinder 2 through the intake valve 5 during the intake step, according to the formula:

$$M_{EGRi}=M_{OVL}+M_{EXH_EGR} \quad [17].$$

According to a particular option of implementation, the estimated mass $M_{EXH_EGR}$ of exhausted gases present in the combustion chamber under conditions of exhaust gas internal recirculation is calculated using the following relation:

$$M_{EXH_EGR}=(P_{EXH}*V_{cc})/(R*T_{EXH}) \quad [18],$$

where $P_{EXH}$ is the pressure of the detected exhaust gas flow; $T_{EXH}$ is the detected exhaust gas flow temperature; $V_{cc}$ is the estimated or calculated volume of the combustion chamber of cylinder 2; R is the constant of the fresh air and/or exhaust gas mix.

According to a further embodiment of the method, applicable in a condition of scavenging (SCAV), wherein the exhaust pressure $P_{EXH}$ is less than the intake pressure P and the fresh air from the intake during the intersection flows directly towards the exhaust, taking away the residual exhaust gas in the combustion chamber, the method comprises the further step of calculating the total air mass which flows from the intake manifold to the exhaust manifold during the intersecting step $M_{SCAV}$ as the difference between the aforesaid estimated mass of the gaseous flow $M_{OVL}$ which flows through the intersecting step and a residual mass $M_{EXH_SCAV}$ of exhaust gases inside the combustion chamber of the cylinder 2 and directly directed to the exhaust manifold 6 through the respective exhaust valve 7.

Such a calculation can made using the formula:

$$M_{SCAV}=M_{OVL}-M_{EXH_SCAV} \quad [19].$$

According to a possible example of embodiment, the aforesaid exhaust gas residual mass $M_{EXH_SCAV}$ is calculated using the following equation:

$$M_{EXH_SCAV}=[(P_{EXH}*V_{cc})/(R*T_{EXH})]*f_{SCAV}(M_{OVL},n) \quad [20],$$

where $P_{EXH}$ is the pressure of the detected exhaust gas flow; $T_{EXH}$ is the detected exhaust gas flow temperature; $V_{cc}$ is the estimated or calculated volume of the combustion chamber of cylinder 2; R is the constant of the fresh air and/or exhaust gas mix.

$f_{SCAV}(M_{OVL}, n)$ is a multiplication factor, which is a function of the gaseous flow mass $M_{OVL}$ which flows through the intersecting step, and of the engine speed n.

According to another possible example of embodiment, the aforesaid exhaust gas residual mass $M_{EXH_SCAV}$ is calculated by using the following equation:

$$M_{EXH_SCAV}=M_{OVL}*f_{SCAV}(M_{OVL},n)*g_2(g,n) \quad [21],$$

wherein $M_{OVL}$ is the gaseous flow mass which flows through the intersecting step; $f_{SCAV}(M_{OVL}, n)$ is a multiplication factor, which is a function of the gaseous flow mass ($M_{OVL}$) which flows through the intersecting step and of the engine speed n; $g_2(g,n)$ is a function of the position of the center of gravity G of the intersecting step and the engine speed n.

Embodiments of the method will now be described which specify in greater detail how to determine the aforementioned OFF variable which represents the mass of gases produced by combustion in the previous work cycle present in cylinder 3 (either because they did not escape from cylinder 3 or because they were sucked back into cylinder 3).

The filling model is designed to determine the variable OFF, which varies according to the working conditions, in particular as a function of the ratio between the pressure in the intake manifold 4 and the pressure in the exhaust manifold 6.

If the pressure in exhaust manifold 6 is higher than the pressure in the intake manifold 4 ("internal EGR" mode), the variable OFF corresponds to the total mass MEGRi of "internal EGR" expressed according to the aforesaid formula [17].

If the pressure in the intake manifold 4 is higher than the pressure in exhaust manifold 6 ("scavenging" mode), the OFF variable is instead expressed by the following formula [22] (which comprises variables whose meaning has already been explained above):

$$\mathrm{OFF}=(P_{EXH}*V_{CC})/(R*T_{EXH})-M_{EXH_SCAV} \quad [22].$$

In this case, indeed, the gases produced by combustion in the previous work cycle and present in cylinder 2 (because they have not escaped) are at least partially directed directly to the exhaust manifold 6 during the intersecting step through the respective exhaust valve 7. The value assumed by the OFF variable is positive or null; if the entire flow of gases produced by combustion in the previous working cycle and present in cylinder 3 is directed directly to exhaust manifold 6 during the intersecting step through the exhaust valve 7, the electronic control unit 10 may saturate the OFF variable to null value.

If the OFF variable takes on a negative value, e.g., due to dynamic and cooling effects in the combustion chamber of cylinder 3, the electronic control unit 10 may saturate the OFF variable to a negative value.

Note that the model described above has been implemented in a control unit and experimentally validated with satisfactory results, that is, with an estimation accuracy below 3% absolute error, compared to the measurement of the air mass at the engine bench.

In other words, according to an embodiment of the method, the step of determining the mass of gases generated by the combustion in the previous operating cycle OFF and present in cylinder 2 provides first of all recognizing if the exhaust gas flow pressure $P_{EXH}$ in the exhaust manifold 6 is greater or less than the intake gas flow pressure P in the intake manifold 4.

If the pressure in the exhaust manifold $P_{EXH}$ is greater than the pressure in the intake manifold P, the steps are provided of determining, based on the filling model, a measured or estimated value for each of a second group of reference quantities comprising exhaust gas flow pressure $P_{EXH}$, temperature of the exhaust gas flow $T_{EXH}$, volume of the combustion chamber of cylinder $V_{cc}$, and mass flowing from the exhaust to the intake $M_{OVL}$ through intake valve 5 and exhaust valve 7 and which is then sucked back into cylinder 2, during the intake step, through the intake valve 5; then, calculating the mass of gases produced by the combustion in the previous operating cycle OFF and present in cylinder 2 according to the aforesaid second group of reference quantities.

If the pressure in the exhaust manifold $P_{EXH}$ is lower than the pressure in the intake manifold P, there are provided the steps of: determining, based on the filling model, a measured or estimated value for each of a second group of reference quantities comprising exhaust gas flow pressure $P_{EXH}$, temperature of the exhaust gas flow $T_{EXH}$, volume of the combustion chamber of cylinder $V_{cc}$, and residual mass of exhaust gas $M_{EXH_SCAV}$ present in the combustion chamber of cylinder 2 and directed directly to the exhaust manifold 6 through the respective exhaust valve 7; then, calculating the mass of gases produced by combustion in the previous operating cycle OFF and present in cylinder 2 according to the aforesaid second group of reference quantities.

According to an option of implementation, if the pressure in the exhaust manifold PEXH is greater than the pressure in the intake manifold P, the mass of gases generated by the combustion in the previous operating cycle OFF and present in cylinder 2 is calculated using the following relation:

$$\mathrm{OFF}=M_{OVL}+(P_{EXH}*V_{cc})/(R*T_{EXH}) \quad [23],$$

where R is the constant of fresh air and/or exhaust gas mix.

According to an option of implementation, the quantity $M_{OVL}$ is calculated using the formula [14], taking into account formula [15] above.

According to another option of implementation, if the pressure in the exhaust manifold $P_{EXH}$ is lower than the pressure in the intake manifold P, the mass of gases generated by the combustion in the previous operating cycle OFF and present in cylinder 2 is calculated using the aforesaid relation [22]:

$$\mathrm{OFF}=(P_{EXH}*V_{cc})/(R*T_{EXH})-M_{EXH_SCAV},$$

where R is the constant of fresh air and/or exhaust gas mix.

According to an option of implementation, the quantity $M_{EXH_SCAV}$ is calculated using the formula [20] or the formula [21] above.

According to a further embodiment of the method, the estimation of the air mass trapped in the cylinder is refined taking into account empirical correction factors.

In particular, according to such an embodiment, the mass m of air trapped in each cylinder 2 is calculated according to a number of multiplication coefficients ($K_1$, $K_2$) which take into account the angle of angular displacement VVTi of the intake valve 5, the angle of angular displacement (VVTe) of the exhaust valve 7 and the rotation speed n of the internal combustion engine 1.

According to an implementation option, the mass m of air trapped in each cylinder 2 is calculated as a function of a first multiplication coefficient $K_1$ which takes into account the intake valve displacement angle VVti and the exhaust valve displacement angle VVte, and as a function of a second multiplication coefficient $K_2$ which takes into account the speed n of rotation of the internal combustion engine and the exhaust valve displacement angle VVte.

According to a specific implementation example, the mass m of air trapped in each cylinder 2 is calculated using the following relation [24]:

$$m=[(P*V)-\mathrm{OFF}]*K_T*K_1(VVT_i,VVT_e)*K_2(VVT_e,n),$$

where $K_T$ is a third coefficient dependent on the temperature T detected in the intake manifold 4 and the temperature $T_{H2O}$ of the coolant fluid of the engine.

According to an implementation option, referring to the aforementioned functions $f_1$ and $f_2$ the coefficient $K_T$ is calculated according to the formula:

$$K_T=f_1(T,P)*f_2(T_{H2O},P) \quad [25].$$

An embodiment of the method will now be described which can be applied to an internal combustion engine 1 comprising an external recirculation circuit of the exhaust gases EGRe having known flow rate, corresponding to a mass $M_{EGRe}$ recirculated by the external circuit for each cylinder per cycle.

According to such an embodiment, the step of calculating the mass m of air trapped in each cylinder 2 comprises calculating the mass m of air trapped in each cylinder 2 using the following formula:

$$m=(P*V-\mathrm{OFF})*f_1(T,P)*f_2(T_{H2O},P)-M_{EGRe} \quad [26].$$

According to an implementation option, the step of calculating the mass m of air trapped in each cylinder 2 comprises calculating the mass m of air trapped in each cylinder 2 using the following formula [27]:

$$m=[(P*V)-\mathrm{OFF}]*K_T*K_1(VVT_i,VVT_e)*K_2(VVT_e,n)-M_{EGRe}.$$

According to an implementation option, if the external EGR mass flow rate $\dot{M}_{EGR}$ is known and the total number of cylinders which intake $N_{cyl}$, the external EGR mass $M_{EGRe}$ taken in by each cylinder per cycle can be derived from the equation:

$$\dot{M}_{EGR}=(M_{EGRe}*N_{cyl}*n)/2,$$

thus obtaining the equation:

$$M_{EGRe}=2\dot{M}_{EGR}/(N_{cyl}*n).$$

An embodiment of the method will now be described which can be applied to a situation in which a scavenging condition occurs, and in which furthermore the internal combustion engine 1 comprises an external recirculation circuit of the exhaust gases EGRe having known flow rate, corresponding to a mass $M_{EGRe}$ recirculated by the external circuit for each cylinder per cycle.

In such an embodiment, the method comprises the further step of calculating the ratio $R_{EGR}$ between the aforesaid mass recirculated by the external circuit $M_{EGRe}$ per cylinder per cycle and the total mass $M_{TOT}$ sucked by the engine per cylinder per cycle, that is the total mass of the gas mixture flowing in the intake duct 6 of cylinder 2. So, $R_{EGR}=M_{EGRe}/M_{TOT}$.

Furthermore, the step of calculating the mass of air which flows from the intake manifold to the exhaust manifold during the intersecting step $M_{SCAV}$ comprises calculating the total mass of gas inside the cylinder $M_{SCAV}$ through the following equation:

$$M_{SCAV}=(M_{OVL}-M_{EXH_SCAV})*(1-R_{EGR}) \quad [28].$$

An embodiment of the method will now be described, which can be applied to a situation in which a scavenging condition occurs, and moreover in which the internal combustion engine 1 comprises an external recirculation circuit of the exhaust gases EGRe having known flow rate, corresponding to a mass $M_{EGRe}$ recirculated by the external circuit for each cylinder per cycle.

In such an embodiment, the method comprises the further step of calculating the ratio $R_{EGR}$ between the aforesaid mass recirculated by the external circuit $M_{EGRe}$ per cylinder per cycle and the total mass $M_{TOT}$ sucked by the engine per cylinder per cycle, that is the total mass of the gas mixture flowing in the intake duct 6 of cylinder 2.

Furthermore, the step of calculating the mass of gases generated by the combustion in the previous operating cycle OFF and present in cylinder 2 is calculated through the following equation [29]:

$$\mathrm{OFF}=(P_{EXH}*Vcc)/(R*T_{EXH})-[M_{EXH_SCAV}*(1-R_{EGR})].$$

According to an embodiment of the method, the aforesaid relation between mass trapped in cylinder 2 and intake pressure P in the intake duct 4 is expressed through the following formula [30]:

$$m=[(P*f_v(IVC,n)*f_h(H,n)*f_p(P,n))-\mathrm{OFF}]*K_T*K_1(VVT_i,VVT_e)*K_2(VVT_e,n).$$

According to different possible embodiments of the method, the intake pressure P and/or the lift H of intake valve and/or said intake valve angular displacement VVTi and/or said exhaust valve angular displacement VVTe and/or said temperature T in the intake manifold 4 and/or said temperature $T_{H2O}$ of the coolant fluid of the engine and/or said exhaust pressure $P_{EXH}$ in the exhaust manifold 6 and/or said detected temperature of the exhaust gas flow $T_{EXH}$ are detected through respective sensors placed in respective positions.

According to the different embodiments of the method, the aforesaid coefficients or maps or functions $f_v$(IVC,n) and/or $f_h$(H,n) and/or $f_p$(P,n) and/or $f_1$(T,P) and/or $f_2$(TH2O, P) and/or $f_e$(TVC,n), and/or $g_e$(OVL,n) and/or $h_e$(OVL,n) and/or $f_s$(TVC,n), and/or $g_s$(OVL,n) and/or $h_s$(OVL,n) and/or $\beta(P/P_0,n)$ and/or A(OVL,n) and/or fo(H,n) and/or G(g,n) and/or $f_{SCAV}(M_{OVL}, n)$ and/or $g_2$(g,n) and/or $K_1$ and/or $K_2$, and/or $K_T$ are determined using known theoretical relations or relations obtained by experimentation or characterization performed on engine 1 prior to use under operating conditions, and are saved in a memory that is accessible for controlling the operation of engine 1.

The aforesaid steps of calculating or determining steps are performed by one or more processors that control the operation of engine 1 (e.g., the aforesaid control unit 10).

The estimated value of the mass of air trapped in cylinder 3, according to any one of the embodiments described above, can be used in many useful ways, for example, to obtain an objective value for the air/fuel ratio (or title) of the exhaust gases. In other words, once the mass m of air trapped in each cylinder 3 has been determined through the filling model for each cycle, the electronic control unit 30 determines the amount of fuel to be injected into the cylinder 3 which allows the objective value of the air/fuel ratio of the exhaust gases to be obtained.

Equally advantageously, the relations described above between mass m of air trapped in the cylinder and intake pressure P (or other quantities) can be expressed as a function of the intake pressure P (or other quantities), to obtain "objective values".

In this regard, a method for controlling and implementing the operation of at least one cylinder 2 of an internal combustion engine 1, also comprised in the invention is described here (such a method will be called later, for brevity, also "charging and controlling model" or "charging model").

Such a method comprises the steps of determining, on the basis of a calculation model using measured and/or estimated physical quantities, an objective mass $M_{OBJ}$ of combustion air required for each cylinder 2 to meet an engine torque requirement; then, deriving a relation between mass trapped in cylinder 2 and intake pressure P in intake duct 4, by performing a method to determine the mass m of air trapped in each cylinder 2 according to any of the embodiments previously described in this description.

The method for controlling and implement the operation of at least one cylinder also provides calculating an objective pressure value $P_{OBJ}$ which must be present in the intake manifold 4 to obtain the aforesaid objective mass $M_{OBJ}$ in cylinder 2, on the basis of the aforesaid relation between mass trapped in cylinder 2 and intake pressure P, as a function of measured, estimated or imposed values of intake valve lift H of the intake valve 5 and/or of the intake valve displacement angle VVTi and/or of the exhaust valve displacement angle VVTe; and finally to activate a pressure and flow control valve of the intake line 4 so as to obtain the aforesaid objective pressure $P_{OBJ}$ in the intake line 4 and the aforesaid objective mass $M_{OBJ}$ in cylinder 2.

According to an implementation option, the aforesaid relation between objective mass MOBJ trapped in cylinder 2 and objective intake pressure $P_{OBJ}$ in the intake duct 4 is expressed using the following formula [31]:

$$M_{OBJ}=[(P_{OBJ}*f_v(IVC,n)*f_h(H,n)*f_p(P,n))-\mathrm{OFF}]*K_T*K_1(VVT_i,VVT_e)*K_2(VVT_e,n),$$

where OFF is the mass of gases generated by the combustion in the previous operating cycle and present in the cylinder; $f_v$(IVC,n), $f_h$(H,n), $f_p$(P,n) are maps the product of which expresses the actual volume V inside each cylinder 2, wherein the first map $f_v$(IVC,n) is a function of the intake valve closure delay angle IVC and of the engine rotation speed n, the second map $f_h$(H,n) is a function of the intake valve lift H and the engine rotation speed n, and the third map $f_p$(P,n) is a function of the intake pressure P and the engine rotation speed n.

$K_1$ and $K_2$ are multiplication coefficients which take into account the angle of intake valve angular displacement VVTi, the angle of exhaust valve angular displacement VVTe and the rotation speed n of engine 1.

$K_T$ is a coefficient dependent on the temperature T detected in the intake manifold 4 and on the temperature TH2O of the coolant fluid of the engine.

According to an example already illustrated above, $K_T$ can be expressed by the formula:

$$K_T=f_1(T,P)*f2(T_{H2O},P).$$

Further details are given below, as an example, on the aforesaid method to control and implement the operation of an internal combustion engine cylinder.

According to an implementation option, in the electronic control unit 10 a calculation chain is also stored which, starting from the engine torque demanded by the user acting on the accelerator pedal, can provide the combustion air mass $M_{OBJ}$ required for each cylinder 2 to satisfy such engine torque demand. The calculation chain provides that, following the user's action on the accelerator pedal, through maps stored in the electronic control unit 10 and knowing the speed n of rotation (or rpm) of engine 1, the engine torque $C_r$ required at drive shaft 11 is determined, on the basis of which the total driving torque $C_t$ required at drive shaft 11 is then determined, and then the engine torque $C_{t,cyl}$ required for each cylinder 2 is calculated. The calculation chain may also determine the mass $M_{OBJ}$ of combustion air required for each cylinder 2 to obtain the aforesaid engine torque value $C_{t,cyl}$.

Once the aforesaid mass $M_{OBJ}$ has been calculated to obtain the said engine torque value $C_{t,cyl}$, the electronic control unit 30 is prepared to use the equations between m and P previously described (for example, the aforesaid formulas [1] or [10] or [24] or [27] of the filling model) in an inverse manner (expressed explicitly with respect to variables different from m) with respect to that described above.

In other words, for a given value of the mass $M_{OBJ}$ of combustion air required for each cylinder 2 (corresponding, in this case, to the mass m of air trapped in each cylinder 2 for each cycle, according to one of the aforesaid formulae), the objective pressure value $P_{OBJ}$ inside intake manifold 4 is calculated from the same formulas. For example, starting with formula [24], interpreting m as $M_{OBJ}$ and P as $P_{OBJ}$ gives the following formula [32]:

$$P_{OBJ}=[M_{OBJ}/(K_T*K_1*K_2)+\mathrm{OFF}]/V.$$

The throttle valve 12 is consequently controlled by the electronic control unit 10 to achieve the objective pressure value $P_{OBJ}$ determined by the formula [32] inside the intake manifold 4.

Typically, the throttle valve dynamics are faster than VVH dynamics, which is faster or comparable to VVT dynamics, so the charge control principle shown above works correctly.

If the VVH dynamic is higher than that of the throttle valve (or intake manifold), or in the absence of the throttle valve, the charge model can be used to calculate the target H lift, given the objective air mass.

As noted above, the filling model stored inside the electronic control unit 10 uses the measured and/or estimated physical quantities (such as temperature and pressure values). The filler model may also use other physical quantities measured and/or objective, for example: VVT position (which can be measured for the estimate of m, and measured or "objective" for the control and charge model), and/or VVH position (which can be measured for the estimate of m, and measured or "objective" for the controlling and charging model).

The charging and controlling model here described was tested, for example on a 1500 cc Turbo engine with VVH and VVT intake and exhaust, obtaining satisfactory accuracy within the performance index defined for this type of control, i.e. ±3%.

In all the situations illustrated above, starting from the estimated values of mass per cylinder and per engine cycle, it is possible to calculate the flow rates of the internal combustion engine 1, considering the number of cylinders and the engine speed n (in particular, starting from the estimated value of mass per cylinder per engine cycle, and multiplying it by the number of cylinders, by the engine speed n, and by ½).

As can be seen, the purpose of the present invention is fully achieved by the methods of estimating and controlling described above, the advantages of which are apparent from the above discussion.

In particular, the methods described, and the related filling models, allow determining the mass m of air trapped in each cylinder, and also the total $M_{TOT}$ air mass sucked in by the internal combustion engine, and/or the scavenging mass $M_{SCAV}$ and/or the internal EGR mass $M_{EGRI}$.

The determination of the aforesaid variables is carried out by the method efficiently, i.e., with adequate precision (as previously indicated, based on experimentation), effectively, that is, quickly and without requiring excessive computing power in the electronic control unit 10, and cost-effectively, since it does not require the installation of expensive additional components and/or sensors, such as the air flow meter.

To the embodiments of the method for determining the mass of air trapped in each cylinder of an internal combustion engine and the method for controlling and implementing the operation of at least one cylinder of an internal combustion engine, described above, a person skilled in the art may make modifications, adaptations, and substitutions of elements with others functionally equivalent, to meet contingent requirements, without departing from the scope of the following claims.

All the sign conventions used in all the above formulas are intended to be consistent with the diagrams shown in the attached figures.

All the quantities expressed as functions, in all the formulas above, can be understood as maps and/or stored vectors.

All the features described above as belonging to one possible embodiment may be implemented independently from the other described embodiments. It is further worth noting that the word "comprising" does not exclude other elements or steps and that the article "a" does not exclude a plurality. The figures are not in scale because they privilege the requirement of appropriately highlighting the various parts for the sake of greater clarity of illustration. The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A method for determining the mass (m) of air trapped in each cylinder of an internal combustion engine comprising a number of cylinders, wherein each of the cylinders is connected to an intake manifold from which it receives fresh air through at least one respective intake valve, and to an exhaust manifold into which it introduces the exhaust gases generated by the combustion through at least one respective exhaust valve, wherein the at least one intake valve is driven so as to vary the lift (H) of the intake valve in controlled manner, the method comprising the steps of:

determining, based on a filling model using measured and/or estimated physical quantities, a value for each quantity of a first group of reference quantities comprising intake pressure (P) measured inside the intake manifold, engine rotation speed (n), mass of gases produced by the combustion in the previous operating cycle (OFF) and present inside the cylinder estimated as a function of said lift (H) and on the closing delay angle (IVC) of the intake valve depending on said lift (H);

determining, based on said filling model, the effective inner volume (V) of each cylinder as a function of said engine rotation speed (n), of said lift (H) of the intake valve, of said closing delay angle (IVC) of the intake valve and of said intake pressure (P); and determining the mass (m) of air trapped in each cylinder as a function of the first group of reference quantities and of the actual volume (V) inside each cylinder, through the relation:

$$m=(P*V)-\mathrm{OFF}.$$

2. The method as set forth in claim 1, wherein the at least one intake valve is also driven so as to vary the intake valve angular displacement (VVTi) in controlled manner, and/or wherein the at least one exhaust valve is driven so as to vary the exhaust valve angular displacement (VVTe) in controlled manner; and wherein said step of determining a value for a first group of reference quantities comprises determining said closing delay angle (IVC) of the intake valve based on both the lift (H) of the intake valve and the intake valve angular displacement (VVTi).

3. The method as set forth in claim 2, further comprising the steps of:

further driving the intake valve by an intake valve phase shifter by varying the intake valve angular displacement (VVTi) in controlled manner so that both the intake valve opening advance angle (IVO) and the intake valve closing delay angle (IVC) not only depend on the lift (H) but also on the intake valve angular displacement (VVTi); and driving the exhaust valve via an exhaust valve phase shifter by varying the exhaust valve angular displacement (VVTe) in controlled manner so that both the exhaust valve opening advance angle (EVO) and the exhaust valve closing delay angle (EVC) depend on the exhaust valve angular displacement (VVTe).

4. The method as set forth in claim 3, wherein the step of driving comprises:

determining the intake valve opening advance angle (IVO) using the relation $$IVO(H)=IVO_{ref}-\Delta ivo(H)-VVTi,$$

where $IVO_{ref}$ is a reference value of the opening advance angle of the intake valve in the absence of phase shifting, VVTi is the displacement angle of the intake valve phase shifter with respect to a respective reference position corresponding to said reference value $IVO_{ref}$;

determining the intake valve closing delay angle (IVC) using the relation $$IVC(H)=IVC_{ref}-\Delta ivc(H)+VVTi,$$

where $IVC_{ref}$ is a reference value of the closing delay angle of the intake valve in the absence of phase shifting;

determining the exhaust valve opening advance angle (EVO) using the relation $$EVO=EVO_{ref}-VVTe,$$

where $EVO_{ref}$ is a reference value of the exhaust valve opening advance angle in the absence of phase shifting and VVTe is the displacement angle of the exhaust valve phase shifter with respect to a respective reference position indicated by said reference value $EVO_{ref}$; and determining the exhaust valve closing delay angle (EVC) using the relation $$EVC=EVC_{ref}+VVTe,$$

where $EVC_{ref}$ is a reference value of the exhaust valve closing delay angle in the absence of phase shifting.

5. The method as set forth in claim 1, wherein said first group of reference quantities further comprises the temperature (T) detected inside the intake manifold and the temperature ($T_{H2O}$) of the coolant fluid of the engine; and wherein the step of determining the mass (m) of air trapped in each cylinder comprises calculating the mass (m) of air trapped in each cylinder as a function of the first group of reference quantities and of the actual volume (V) inside each cylinder, through the relation:

$$m=[(P*V)-\mathrm{OFF}]*f_1(T,P)*f_2(T_{H2O},P),$$

where $f_1(T, P)$ and $f_2(T_{H2O}, P)$ are known functions belonging to said filling model.

6. The method as set forth in claim 1, further comprising the step of:

driving the intake valve via an intake valve lift shifter by varying the law of lift of the intake valve in controlled manner so as to define both the lift (H), and the intake valve opening advance angle (IVO) and the intake valve closing delay angle (IVC) according to one single degree of freedom (γ).

7. The method as set forth in claim 6, wherein the step of driving comprises:

determining the intake valve opening advance angle (IVO) using the relation $$IVO(H)=IVO_{hmax}-\Delta ivo(H),$$

where IVO'max is the intake valve opening advance angle corresponding to the maximum lift and Δivo(H) is a variation of intake valve opening advance angle depending on the controlled lift (H); and determining the intake valve closing delay angle (IVC) using the relation $$IVC(H)=IVC_{hmax}-\Delta ivc(H),$$

where $IVC_{hmax}$ is the intake valve closing delay angle corresponding to the maximum lift and Δivc(H) is a variation of intake valve closing delay angle depending on the controlled lift (H).

8. The method as set forth in claim 1, comprising, if the engine operates under the condition of exhaust gas internal recirculation (EGRi), the further step of:

calculating the combustion chamber volume (Vcc) of the cylinder based on a fourth map $f_e$ (TVC, n) which is a function of a first parameter (TVC) and of the engine rotation speed (n), on a fifth map $g_e$ (OVL, n) which is a function of a second parameter (OVL) and of the engine rotation speed (n), and on a sixth map $h_e$ (H,n) which is a function of the lift (H) and of the engine rotation speed (n), wherein said first parameter (TVC) is alternatively equal to the closing delay angle (EVC) of the exhaust valve or to the maximum between zero and the minimum value among the closing delay angle (EVC) of the exhaust valve and the value of the opening advance angle (IVO) of the intake valve multiplied by −1, and wherein said second parameter (OVL) is representative of the duration of the intersecting step between the intake and exhaust curves and is defined as the sum of the exhaust valve closing delay angle (EVC) and the intake valve opening advance angle (IVO).

9. The method as set forth in claim 8, wherein the combustion chamber volume ($V_{cc}$) is calculated using the formula:

$$V_{cc}=f_e(TVC,n)*g_e(OVL,n)*h_e(H,n),$$

where $f_e$, $g_e$, $h_e$ are known functions belonging to said filling model.

10. The method as set forth in claim 1, wherein if the engine may operate under a scavenging condition wherein the intake pressure is greater than the exhaust pressure, thus causing the intake of fresh air which carries away the residual exhaust gases in the combustion chamber, the method comprises the further step of:

calculating the combustion chamber volume ($V_{cc}$) of the cylinder based on a fourth map $f_s$(TVC, n) which is a function of a first parameter (TVC) and of the engine rotation speed (n), based on a fifth map $g_s$ (OVL,n) which is a function of a second parameter (OVL) and of the engine rotation speed (n), and on a sixth map $h_s$ (H,n) which is a function of the lift (H) and the engine rotation speed (n), wherein said first parameter (TVC) is alternatively equal to the closing delay angle (EVC) of the exhaust valve or to the maximum between zero and the minimum value among the closing delay angle (EVC) of the exhaust valve and the value of the opening advance angle (IVO) of the intake valve multiplied by −1, and wherein said second parameter (OVL) is representative of the duration of the intersecting step between the intake and exhaust curves and is defined as the sum of the exhaust valve closing delay angle (EVC) and the intake valve opening advance angle (IVO).

11. The method as set forth in claim 10, wherein the combustion chamber volume ($V_{cc}$) is calculated using the formula:

$$V_{cc}=f_s(TVC,n)*g_s(OVL,n)*h_s(H,n),$$

where $f_s$, $g_s$, $h_s$ are known functions belonging to said filling model.

12. The method as set forth in claim 1, comprising the further step of calculating the mass of the gaseous flow ($M_{OVL}$) which flows through the intersecting step, that is through the intake valve and the exhaust valve, in the case of exhaust gas internal recirculation (EGRi) or of scavenging (SCAV), on the basis of the relation:

$$M_{OVL}=\text{PERM}*\beta(P/P_0,n)*P_0/P_{0_REF}*(T_{0_REF}/T_0)^{1/2}/n,$$

where PERM is the hydraulic permeability of the intersection; n is the engine speed;

$P_{0_REF}$ is a reference pressure upstream of the passage section or intersection;

$T_{0_REF}$ is a reference temperature upstream of the passage section or intersection;

$T_0$ is the temperature measured upstream of the passage section or intersection;

β ($P/P_0$,n) is a compression factor of a flow through an orifice, depending on the ratio between the pressures downstream and upstream of the orifice and on the engine speed (n); and where, under a condition of internal recirculation of the exhausted gases, $P_0$ is the exhaust pressure and P is the intake pressure, or, under a condition of scavenging, $P_0$ is the intake pressure and P is the exhaust pressure.

13. The method as set forth in claim 12, wherein said hydraulic permeability (PERM) of the intersection is calculated using the following relation:

$$\text{PERM}=A(OVL,n)*f_0(H,n)*G(g,n),$$

where A(OVL,n) is a first function depending on the engine speed (n) and on the duration of the intersecting step (OVL) during which the intake valve and the exhaust valve are simultaneously opened;

fo(H,n) is a second function dependent on the lift (H) and the engine speed (n); and G (g,n) is a third function representative of the center of gravity of the intersecting region, depending on the engine speed (n) and a geometrical parameter (g) representative of the angular deviation between the upper dead point and the center of gravity (G) of the intersecting step.

14. The method as set forth in claim 12, wherein, under a condition of exhaust gas internal recirculation (EGRi) wherein the exhaust pressure ($P_{EXH}$) is greater than the intake pressure (P), the method comprises the further step of:

calculating the total mass ($M_{EGRt}$) of gas present in the cylinder as the sum of an estimated mass ($M_{EXH_EGR}$) of exhaust gases in the combustion chamber under conditions of exhaust gas internal recirculation and of said estimated mass of gaseous flow ($M_{OVL}$) which flows through the intersecting step, that is the mass of gaseous flow which flows from the exhaust to the intake through the intake valve and the exhaust valve and which is then sucked back into the cylinder through the intake valve during the intake step, according to the formula:

$$M_{EGRi}=M_{OVL}+M_{EXH_EGR}.$$

15. The method as set forth in claim 14, wherein the estimated mass ($M_{EXH_EGR}$) of exhausted gases in the combustion chamber under conditions of exhaust gas internal recirculation is calculated by using the following relation:

$$M_{EXH_EGR}=(P_{EXH}*V_{cc})/(R*T_{EXH}),$$

where $P_{EXH}$ is the gas flow pressure detected in the exhaust;

$T_{EXH}$ is the gas flow temperature detected in the exhaust;

$V_{cc}$ is the estimated or calculated volume of the combustion chamber of the cylinder; and R is the constant of fresh air and/or exhaust gas mix.

16. The method as set forth in claim 12, wherein under a condition of scavenging (SCAV), wherein the exhaust pressure ($P_{EXH}$) is less than the intake pressure (P) and the fresh air from the intake during the intersection flows directly towards the exhaust, taking away the residual exhaust gas in the combustion chamber, the method comprises the further step of:

calculating the total air mass which flows from the intake manifold to the exhaust manifold during the intersecting step ($M_{SCAV}$) as the difference between said estimated mass of the gaseous flow ($M_{OVL}$) which flows through the intersecting step and a residual mass ($M_{EXH_SCAV}$) of exhaust gases inside the combustion chamber of the cylinder and directly directed to the exhaust manifold through the respective exhaust valve, according to the formula:

$$M_{SCAV}=M_{OVL}-M_{EXH_SCAV}.$$

17. The method as set forth in claim 16, wherein said exhaust gas residual mass (MEXH_SCAV) is calculated using the following relation:

$$M_{EXH_SCAV}=[(P_{EXH}*V_{cc})/(R*T_{EXH})]*f_{SCAV}(M_{OVL},n),$$

where $P_{EXH}$ is the gas flow pressure detected in the exhaust;

$T_{EXH}$ is the gas flow temperature detected in the exhaust;

$V_{cc}$ is the estimated or calculated volume of the combustion chamber of the cylinder;

R is the constant of fresh air and/or exhaust gas mix; and $f_{SCAV}(M_{OVL}, n)$ is a multiplication factor, which is a function of the gaseous flow mass ($M_{OVL}$) which flows through the intersecting step, and of the engine speed (n).

18. The method as set forth in claim 17, wherein if the pressure in the exhaust manifold (Ppm) is less than the pressure in the intake manifold (P), the mass of gases generated by the combustion in the previous operating cycle (OFF) and present inside the cylinder is calculated using the following relation:

$$OFF=(P_{EXH}*V_{cc})/(R*T_{EXH})-M_{EXH_SCAV},$$

where R is the constant of fresh air and/or exhaust gas mix.

19. The method as set forth in claim 18, wherein wherein said exhaust gas residual mass (MEXH_SCAV) is calculated using the following relation:

$$M_{EXH_SCAV}=[(P_{EXH}*V_{cc})/(R*T_{EXH})]*f_{SCAV}(M_{OVL},n),$$

where $P_{EXH}$ is the gas flow pressure detected in the exhaust;

$T_{EXH}$ is the gas flow temperature detected in the exhaust;

$V_{cc}$ is the estimated or calculated volume of the combustion chamber of the cylinder;

R is the constant of fresh air and/or exhaust gas mix; and $f_{SCAV}(M_{OVL}, n)$ is a multiplication factor, which is a function of the gaseous flow mass ($M_{OVL}$) which flows through the intersecting step, and of the engine speed (n).

20. The method as set forth in claim 18, wherein a scavenging condition occurs, and moreover wherein the internal combustion engine comprises an external recirculation circuit of the exhausted gases (EGRe) having known flow rate, corresponding to a mass ($M_{EGRe}$) recirculated by the external circuit for each cylinder per cycle;

wherein the method comprises the further step of calculating the ratio ($R_{EGR}$) between said mass recirculated by the external circuit ($M_{EGRe}$) per cylinder per cycle and the total mass ($M_{TOT}$) sucked by the engine per cylinder per cycle, that is the total mass of the gas mixture flowing in the intake duct of the cylinder; and wherein the step of calculating the mass of gases generated by the combustion in the previous operating cycle (OFF) and present inside the cylinder is calculated using the following relation:

$$OFF=(P_{EXH}*V_{cc})/(R*T_{EXH})-[M_{EXH_SCAV}*(1-R_{EGR})].$$

21. The method as set forth in claim 16, wherein said exhaust gas residual mass (MEXH_SCAV) is calculated using the following relation:

$$M_{EXH_SCAV}=M_{OVL}*f_{SCAV}(M_{OVL},n)*g_2(g,n),$$

where $M_{OVL}$ is the gaseous flow mass which flows through the intersecting step;

$f_{SCAV}(M_{OVL}, n)$ is a multiplication factor, which is a function of the gaseous flow mass ($M_{OVL}$) which flows through the intersecting step, and of the engine speed (n); and $g_2(g,n)$ is a function of the position of the center of gravity (G) of the intersecting step and of the engine speed (n).

22. The method as set forth in claim 16, wherein a scavenging condition occurs, and moreover wherein the internal combustion engine comprises an external recirculation circuit of the exhausted gases (EGRe) having known flow rate, corresponding to a mass ($M_{EGRe}$) recirculated by the external circuit for each cylinder per cycle;

wherein the method comprises the further step of calculating the ratio ($R_{EGR}$) between said mass recirculated by the external circuit ($M_{EGRe}$) per cylinder per cycle and the total mass ($M_{TOT}$) sucked by the engine per cylinder per cycle, that is the total mass of the gas mixture flowing in the intake duct of the cylinder; and wherein the mass of air flowing from the intake manifold to the exhaust manifold during the intersecting step ($M_{SCAV}$) is calculated using the following relation:

$$M_{SCAV}=(M_{OVL}-M_{EXH_SCAV})*(1-R_{EGR}).$$

23. The method as set forth in claim 1, wherein the step of determining the mass of gases generated by the combustion in the previous operating cycle (OFF) and present inside the cylinder comprises the steps of:

recognizing if the exhaust gas flow pressure ($P_{EXH}$) in the exhaust manifold is greater or less than the intake gas flow pressure (P) in the intake manifold;

if the exhaust manifold pressure ($P_{EXH}$) is greater than the intake manifold pressure (P):

determining, on the basis of said filling model, a measured or estimated value for each of a second group of reference quantities comprising pressure of the gas flow in the exhaust ($P_{EXH}$), temperature of the gas flow in the exhaust ($T_{EXH}$), volume of the combustion chamber of the cylinder ($V_{cc}$) and mass flowing from the exhaust to the intake ($M_{OVL}$) through the intake valve and the exhaust valve and which is then sucked back into the cylinder through the intake valve during the intake step; and calculating the mass of gases generated by the combustion in the previous operating cycle (OFF) and present inside the cylinder as a function of said second group of reference quantities; and if the exhaust manifold pressure ($P_{EXH}$) is less than the intake manifold pressure (P):

determining, on the basis of said filling model, a measured or estimated value for each of a second group of reference quantities comprising pressure of the gas flow in the exhaust ($P_{EXH}$), temperature of the gas flow in the exhaust ($T_{EXH}$), volume of the combustion chamber of the cylinder ($V_{cc}$) and residual mass of exhaust gas ($M_{OVL_SCAV}$) present inside the combustion chamber of the cylinder and directly directed towards the exhaust manifold through the respective exhaust valve; and calculating the mass of gases generated by the combustion in the previous operating cycle (OFF) and present inside the cylinder as a function of said second group of reference quantities.

24. The method as set forth in claim 23, wherein, if the pressure in the exhaust manifold ($P_{EXH}$) is greater than the pressure in the intake manifold (P), the mass of gases generated by the combustion in the previous operating cycle (OFF) and present inside the cylinder is calculated using the following relation:

$$\mathrm{OFF}=M_{OVL}+(P_{EXH}*V_{cc})/(R*T_{EXH}),$$

where R is the constant of fresh air and/or exhaust gas mix.

25. The method as set forth in claim 24, wherein the gaseous flow ($M_{OVL}$) which flows through the intersecting step, that is through the intake valve and the exhaust valve, in the case of exhaust gas internal recirculation (EGRi) or of scavenging (SCAV), on the basis of the relation:

$$M_{OVL}=\mathrm{PERM}*\beta(P/P_0,n)*P_0/P_{0_REF}*(T_{0_REF}/T_0)^{1/2}/n,$$

where PERM is the hydraulic permeability of the intersection; n is the engine speed;

$P_{0_REF}$ is a reference pressure upstream of the passage section or intersection;

$T_{0_REF}$ is a reference temperature upstream of the passage section or intersection;

$T_0$ is the temperature measured upstream of the passage section or intersection;

$\beta(P/P_0,n)$ is a compression factor of a flow through an orifice, depending on the ratio between the pressures downstream and upstream of the orifice and on the engine speed (n); and where, under a condition of internal recirculation of the exhausted gases, $P_0$ is the exhaust pressure and P is the intake pressure, or, under a condition of scavenging, $P_0$ is the intake pressure and P is the exhaust pressure.

26. The method as set forth in claim 1, wherein the mass (m) of air trapped in each cylinder is calculated according to a number of multiplication coefficients ($K_1$, $K_2$) which take into account the angle of intake valve angular displacement (VVTi), the angle of exhaust valve angular displacement (VVTe) and the rotation speed (n) of the internal combustion engine.

27. The method as set forth in claim 26, wherein the mass (m) of air trapped in each cylinder is calculated as a function of:

a first multiplication coefficient ($K_1$) which takes into account the angle of intake valve angular displacement (VVTi) and the angle of exhaust valve angular displacement (VVTe); and and as a function of a second multiplication coefficient ($K_2$) which takes into account the rotation speed (n) of the internal combustion engine and the angle of exhaust valve angular displacement (VVTe).

28. The method as set forth in claim 27, wherein the mass (m) of air trapped in each cylinder is calculated using the following relation:

$$m=[(P*V)-\mathrm{OFF}]*K_T*K_1(VVT_i,VVT_e)*K_2(VVT_e,n),$$

where $K_T$ is a third coefficient dependent on the temperature (T) detected in the intake manifold and the temperature ($T_{H2O}$) of the coolant fluid of the engine.

29. The method as set forth in claim 28, wherein the step of calculating the mass (m) of air trapped in each cylinder comprises calculating the mass (m) of air trapped in each cylinder using the following formula:

$$m=[(P*V)-\mathrm{OFF}]*K_T*K_1(VVT_i,VVT_e)*K_2(VVT_e,n)-M_{EGRe}.$$

30. The method as set forth in claim 1, wherein the internal combustion engine comprises an external recirculation circuit of the exhausted gases (EGRe) having known flow rate, corresponding to a mass ($M_{EGRe}$) recirculated by the external circuit for each cylinder per cycle; and wherein the step of calculating the mass (m) of air trapped in each cylinder comprises calculating the mass (m) of air trapped in each cylinder using the following formula:

$$m=(P*V-\mathrm{OFF})*f_1(T,P)*f_2(T_{H2O},P)-M_{EGRe}.$$

31. The method as set forth in claim 1, wherein said relation between objective mass trapped in the cylinder and objective intake pressure (P) in the intake duct is expressed by the following formula:

$$m=[(P*f_v(IVC,n)*f_h(H,n)*f_p(P,n))-\mathrm{OFF}]*K_T*K_1(VVT_i,VVT_e)*K_2(VVT_e,n).$$

32. The method as set forth in claim 1, wherein said intake pressure (P) and/or said lift (H) of intake valve and/or said intake valve angular displacement (VVTi) and/or said exhaust valve angular displacement (VVTe) and/or said temperature (T) in the intake manifold and/or said temperature ($T_{H2O}$) of the coolant fluid of the engine and/or said exhaust pressure ($P_{EXH}$) in the exhaust manifold and/or said detected temperature of the exhaust gas flow ($T_{EXH}$) are detected by respective sensors placed in respective positions.

33. The method as set forth in claim 1, wherein:

said coefficients or maps or functions $f_v$(IVC,n) and/or $f_h$(H,n) and/or $f_p$(P,n) and/or f0(T,P) and/or f2($T_{H2O}$,P) and/or fe(TVC,n), and/or $g_e$(OVL,n) and/or he(OVL,n) and/or $f_s$(TVC,n), and/or $g_s$(OVL,n) and/or $h_s$(OVL,n) and/or $\beta(P/P_0,n)$ and/or A(OVL,n) and/or fo(H,n) and/or G(g,n) and/or $f_{SCAV}$ ($M_{OVL}$, n) and/or $g_2$(g,n) and/or $K_1$ and/or $K_2$, and/or $K_T$, are determined using known theoretical relations or relations obtained by steps of experimentation or characterization performed on the engine prior to use under operating conditions, and are saved in memory means accessible to means for controlling the operation of the engine; and wherein said calculating or determining steps are performed by one or more processors comprised in the means for controlling the operation of the engine.

34. A method for controlling and implementing the operation of at least one cylinder of an internal combustion engine, comprising the steps of:

determining, on the basis of a calculation model using measured and/or estimated physical quantities, an objective mass (Mow) of combustion air required for each cylinder to meet a request for an engine torque;

obtaining a relation between mass trapped in the cylinder and intake pressure (P) in the intake duct by carrying out a method for determining the mass (m) of air trapped in each cylinder as set forth in claim 1;

calculating an objective pressure value (Pow) which is to be present in the intake manifold to obtain said objective mass (Mow) in the cylinder based on said relation obtained between mass trapped in the cylinder and intake pressure (P) as a function of measured, estimated or set values of lift (H) of the intake valve and/or of angle of intake valve angular displacement (VVTi) and/or of angle of exhaust valve angular displacement (VVTe); and actuating a pressure and flow rate control valve of the intake duct so as to obtain said objective pressure (Pow) in the intake duct and said objective mass (Mow) in the cylinder.

35. The method as set forth in claim 34, wherein said relation between objective mass (Mow) trapped in the cylinder and objective intake pressure (Pow) in the intake duct is expressed by the following formula:

$$M_{OBJ}=[(P_{OBJ}*f_v(IVC,n)*f_h(H,n)*f_p(P,n))-\mathrm{OFF}]**K_T*K_1(VVT_i,VVT_e)*K_2(VVT_e,n),$$

where OFF is the mass of gases generated by the combustion in the previous operating cycle and present inside the cylinder;

$f_v$(IVC, n), $f_h$(H,n), $f_p$(P,n) are maps the product of which expresses the actual volume (V) inside each cylinder, wherein the first map $f_v$(IVC,n) is a function of the intake valve closure delay angle (IVC) and the engine rotation speed (n), the second map $f_h$(H,n) is a function of the intake valve lift (H) and the engine rotation speed (n), and the third map $f_p$(P,n) is a function of the intake pressure (P) and the engine rotation speed (n);

$K_1$ and $K_2$ are multiplication coefficients which take into account the angle of intake valve angular displacement (VVTi), the angle of exhaust valve angular displacement (VVTe) and the rotation speed (n) of the engine; and $K_T$ is a coefficient dependent on the temperature (T) detected in the intake manifold and on the temperature ($T_{H2O}$) of the coolant fluid of the engine.

36. The method as set forth in claim 1, wherein said step of determining, based on said filling model, the effective inner volume (V) of each cylinder comprises:

determining the effective inner volume (V) based on one or more maps, each map representing a function of one or more variables, wherein said variables comprise one or more of said engine rotation speed (n), intake valve lift (H), intake valve closing delay angle (IVC) and intake pressure (P).

37. The method as set forth in claim 36, wherein said step of determining the actual inner volume (V) of each cylinder comprises:

calculating the actual inner volume (V) of each cylinder using a first map ($f_v$(IVC,n)), a second map ($f_h$(H,n)), a third map ($f_p$(P,n)); and wherein the first map ($f_v$(IVC,n)) is a function of said intake valve closing delay angle (IVC) and of the engine rotation speed (n), the second map ($f_h$(H,n)) is a function of said intake valve lift (H) and of the internal combustion engine rotation speed (n) and the third map ($f_p$(P,n)) is a function of said intake pressure (P) and of the engine rotation speed (n).

38. The method as set forth in claim 37, wherein the actual inner volume (V) of each cylinder is calculated using the relation:

$$V=f_v(IVC,n)*f_h(H,n)*f_p(P,n).$$

* * * * *